US008714544B2

(12) United States Patent
Totsuka

(10) Patent No.: US 8,714,544 B2
(45) Date of Patent: May 6, 2014

(54) MEDIA CASSETTE HOUSING SYSTEM AND IMAGE FORMATION APPARATUS

(75) Inventor: Toshiyuki Totsuka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/586,942

(22) Filed: Aug. 16, 2012

(65) Prior Publication Data

US 2013/0049292 A1 Feb. 28, 2013

(30) Foreign Application Priority Data

Aug. 23, 2011 (JP) ..... 2011-181732

(51) Int. Cl.
*B65H 1/04* (2006.01)

(52) U.S. Cl.
USPC ..... 271/162; 271/164

(58) Field of Classification Search
USPC ..... 271/164, 162, 145; 399/393
See application file for complete search history.

(56) References Cited

U.S. PATENT DOCUMENTS 4,402,498 A * 9/1983 Suzuki ..... 271/164

FOREIGN PATENT DOCUMENTS

| | | | |
|---|---|---|---|
| JP | 03051227 A | * | 3/1991 |
| JP | H10-003242 A | | 1/1998 |
| JP | 2008-120588 A | | 5/2008 |
| JP | 2010-100417 A | | 5/2010 |

* cited by examiner

*Primary Examiner* — Luis A Gonzalez
(74) *Attorney, Agent, or Firm* — Marvin A. Motsenbocker; Mots Law, PLLC

(57) ABSTRACT

A media cassette housing system, which may be usable in an image formation apparatus such as a printer or copier, includes: a guide member configured to guide an insertion of a media cassette from an entrance into an installed position of a cassette housing unit and to guide a pulling out of the media cassette from the installed position to the entrance of the cassette housing unit; and a swingable member provided to the guide member and swingable in inserting and pulling directions of the media cassette. The swingable member includes a slide guide surface configured to come into sliding contact with a slide surface of the media cassette upon the insertion and pulling of the medium cassette.

22 Claims, 9 Drawing Sheets

MEDIA CASSETTE HOUSING SYSTEM AND IMAGE FORMATION APPARATUS

CROSS REFERENCE TO RELATED APPLICATIONS

This application claims priority based on 35 USC 119 from prior Japanese Patent Application No. 2011-181732 filed on Aug. 23, 2011, entitled "MEDIA CASSETTE HOUSING SYSTEM AND IMAGE FORMATION APPARATUS", the entire contents of which are incorporated herein by reference.

BACKGROUND OF THE INVENTION

1. Field of the Invention

This disclosure relates to a media cassette housing system and an image formation apparatus.

2. Description of Related Art

A conventional media cassette housing system or image formation apparatus is configured such that a media cassette, which is configured to contain media therein, is capable of being inserted into and pulled out of a cassette housing unit, which is configured to store the media cassette therein. For the purpose of reducing the force needed to insert and pull out the media cassette, the cassette housing unit is provided with a guide member configured to slidably support the media cassette such that the slidable member extends in the directions in which the media cassette is inserted and pulled out (see Japanese Patent Application Publication No. 2010-100417 (Paragraphs [0025] to [0027] as well as FIGS. 1 and 2) as Patent Document 1, for example).

SUMMARY OF THE INVENTION

The above-mentioned conventional technique, however, has a problem that the guide member partially wears away unevenly due to a slide friction which occurs when the media cassette is inserted into and pulled out of the cassette housing unit.

An object of an embodiment of the invention is to reduce the friction wear of the guide member.

An aspect of the invention is a media cassette housing system including: a guide member configured to guide the insertion of a media cassette from an entrance into an installed position of a cassette housing unit, and to guide the pulling out of the media cassette from the installed position to the entrance of the cassette housing unit; and a swingable member provided to the guide member that is swingable in the inserting and pulling directions of the media cassette. The swingable member includes a slide guide surface configured to come into sliding contact with a slide surface of the media cassette upon the insertion and pulling of the medium cassette.

This aspect makes it possible to reduce the frictional wear of the guide member.

DETAILED DESCRIPTION OF EMBODIMENTS

Figures 1A, 1B:
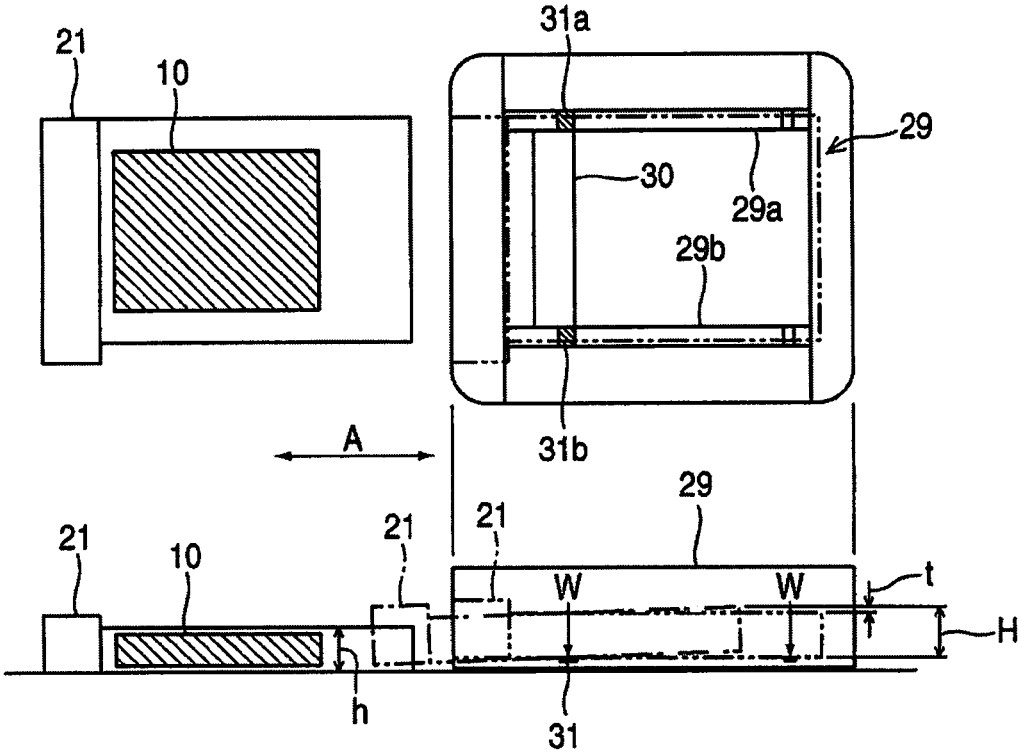
FIGS. 1A and 1B are front and side views of a media cassette and a cassette housing unit of a first embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Descriptions are hereinbelow provided for embodiments of a media cassette housing system and an image formation apparatus.

Embodiment 1

Figure 2:
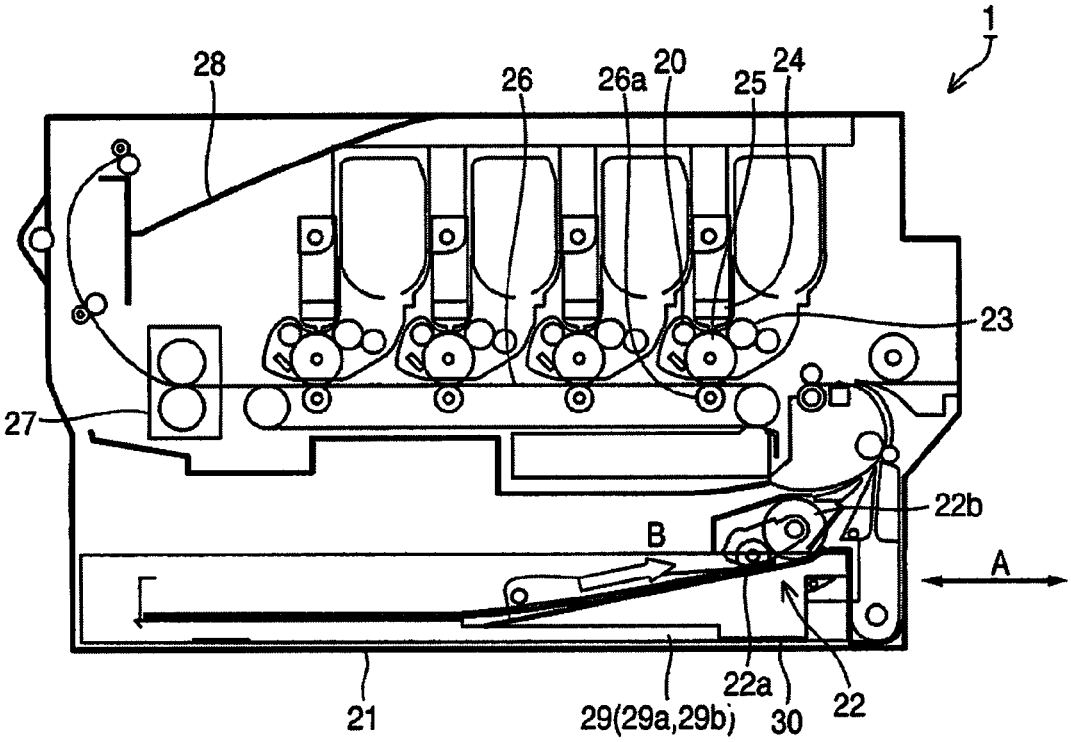
FIG. 2 is a schematic cross-sectional view showing a configuration of an image formation apparatus of the first embodiment.

FIG. 2 is a schematic cross-sectional view showing a configuration of an image formation apparatus of a first embodiment.

In FIG. 2, reference numeral 1 denotes an image formation apparatus, such as a printer, which includes a media cassette housing system wherein a media cassette (e.g. a paper cassette or a sheet cassette) can be stored in a cassette housing unit in an attachable/detachable manner. Image formation apparatus 1 includes: media cassette 21 configured to contain sheets of media; sheet feeder 22 configured to feed the sheets; image formation units configured to form developer images; transfer unit 26 configured to transfer developer images onto the sheets; fixation unit 27 configured to fix the developer images, which are transferred onto the sheets, to the sheets; stacker 28 configured to stack the sheets to which the developer images are fixed. Each image formation unit includes electrical charge device 20, development device 23, light exposure device 24, and photosensitive drum 25.

While separated from the other sheets by sheet feeder 22 including sheet feeder roller 22*a* and separator roller 22*b* on a one-by-one basis, each sheet transported from media cassette 21 in a direction indicated with arrow B in FIG. 2 is conveyed to the image formation units. In each image formation unit, an electrostatic latent image is formed by: causing the surface of photosensitive drum 25 to be evenly electrically charged by electrical charge device 20; and causing the electrically charged surface of photosensitive drum 25 to be exposed to light by light exposure device 24 on the basis of print information. Thereafter, a toner image is formed by: supplying a toner (not illustrated) as a developer, which is electrically charged by development device 23 with the same polarity as that of photosensitive drum 25, to the surface of photosensitive drum 25 on which the electrostatic latent image is formed; and developing the electrostatic latent image.

The toner image formed on photosensitive drum 25 is transferred onto the sheet by transfer roller 26*a* of transfer unit 26 to which a voltage is applied with a polarity opposite to that of the toner. The sheet onto which the toner image is transferred is conveyed to fixation unit 27, and the toner on the sheet is melted by fixation unit 27. Thereby, the toner is fixed to the sheet. The sheet on which the toner image is formed by going through the image formation process in the foregoing way, is conveyed to stacker 28. Such sheets are stacked in stacker 28.

Media cassette 21 is designed to be capable of being attached to and detached from (inserted into and pulled out of) cassette housing unit 29 which is provided to the housing of image formation apparatus 1. Left right arrow A in the drawings indicates the directions in which media cassette 21 is inserted into and pulled out of cassette housing unit 29 (hereinafter referred to as "inserting/pulling directions"). Paired cassette guides 29*a*, 29*b* are configured to guide media cassette 21 and are formed in the respective two ends of cassette housing unit 29 in a direction orthogonal to the directions A. When media cassette 21 is inserted into and pulled out of cassette housing unit 29, the bottom surface of media cassette 29 slides over the guide surfaces of cassette guides 29*a*, 29*b*.

The replenishing of media cassette 21 with sheets, the changing of sheets in one size to sheets in another size in media cassette 21, and the like can be achieved upon pulling out media cassette 21 from the installed position in cassette housing unit 29 toward the entrance of cassette housing unit 29. The sheets in media cassette 21 get ready to be fed from media cassette 21 in the state where media cassette 21 is fully pushed into the installed position in cassette housing unit 29. Cassette guides 29*a*, 29*b* are fastened to cassette housing unit 29 by auxiliary metal plate 30 by use of screws (not illustrated).

Figure 3:
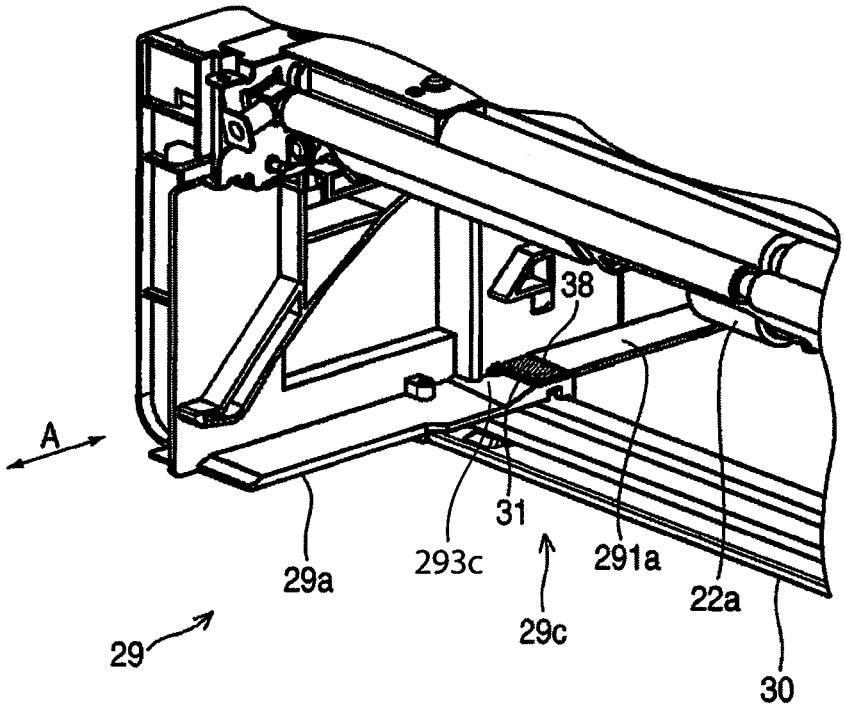
FIG. 3 is a perspective view of a portion of the cassette housing unit of the first embodiment.

FIG. 3 is a perspective view of a portion of the cassette housing unit of the first embodiment, illustrating a positional relationship between cassette guide 29*a*, which is one of the cassette guides constituting part of cassette housing unit 29 shown in FIG. 2, and swingable piece 31*a* (31) as a swingable member which is provided to cassette guide 29*a*. It should be noted that although FIG. 3 shows only cassette guide 29*a* provided at one side with respect to the inserting/pulling directions A of the media cassette, the other swingable piece (not illustrated in FIG. 3) is similarly provided as cassette guide 29*b* on the opposite side with respect to the inserting/pulling directions A of the media cassette.

In FIG. 3, cassette housing unit 29 includes: cassette guide 29*a*, as a guide member, configured to guide the media cassette which is to be inserted into and pull out of cassette housing unit 29; and swingable piece 31*a* attached to cassette guide 29*a*. Swingable piece 31*a* is attached to cassette guide 29*a* to be swingable in the inserting/pulling directions A of the media cassette. The top surface of swingable piece 31*a* serves as slide guide surface 38 configured to slidably guide bottom surface 21*a* (FIGS. 5-6), or a slide surface, of media cassette 21.

Swingable piece 31*a* is formed symmetrical with respect to a surface vertical to the inserting/pulling directions A of the media cassette. Swingable piece 31*a* is fixed to cassette guide 29*a* by being fitted into cassette guide 29*a*. The height of slide guide surface 38 of swingable piece 31*a* is set higher than horizontal guide surface 291*a*, which is a first guide surface of cassette guide 29*a*, by approximately 0.5 mm when media cassette 21 is stored in cassette housing unit 29.

FIGS. 1A and 1B illustrate media cassette 21 and the cassette housing unit of the first embodiment. FIG. 1A is front and side views of media cassette 21, and FIG. 1B is front and side views of the cassette housing unit. It should be noted that: the single-dot chain lines in FIG. 1B illustrate a state (posture) of media cassette 21 in the middle of being stored into cassette housing unit 29; and the two-dot chain lines in FIG. 1B illustrate a state (posture) of media cassette 21 of being completely stored in cassette housing unit 29.

As shown in FIGS. 1A and 1B, media cassette 21 containing sheets 10 is attached to and detached from cassette housing unit 29 by being moved in the inserting/pulling directions A of media cassette 21. Media cassette 21 is configured to move in cassette housing unit 29 with the bottom surface of media cassette 21 guided by cassette guides 29*a*, 29*b* (see FIGS. 1 and 2), and with the bottom surface in sliding contact with slide guide surfaces 38 of swingable pieces 31*a*, 31*b* which are provided to cassette guides 29*a*, 29*b* in the vicinity of the entrance of cassette housing unit 29.

It should be noted that cassette housing unit 29, configured to receive media cassette 21 therein, is formed such that the inner height H of cassette housing unit 29 is higher than a height h of inserted media cassette 21 by a clearance t (for example, approximately 1 mm in the embodiment). Accordingly, the clearance of approximately 1 mm is formed between the upper end of media cassette 21 and the upper end of cassette housing unit 29. This clearance makes it easy for media cassette 21 to be inserted into and pulled out of cassette housing unit 29.

Figure 4:
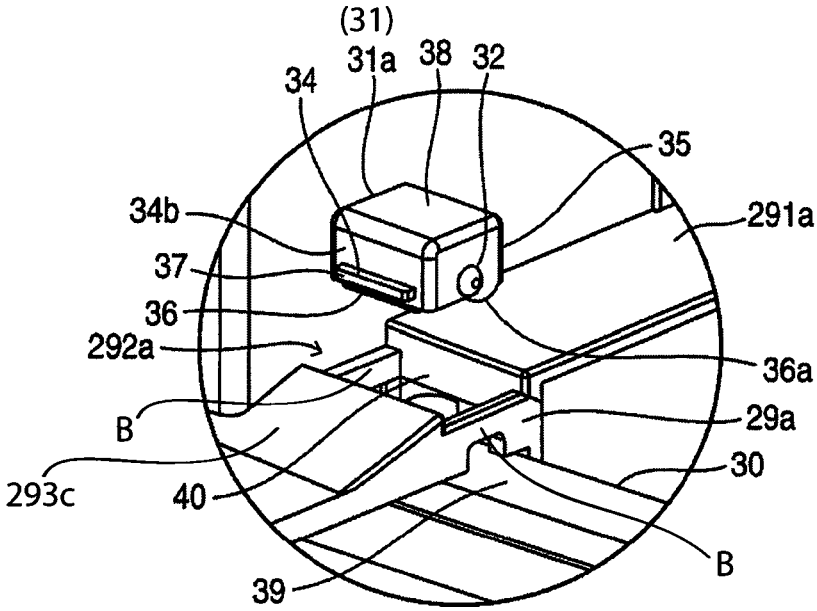
FIG. 4 is a main part perspective view of a swingable piece and the cassette housing unit of the first embodiment.

FIG. 4 is a perspective view of swingable piece 31*a* and support 292*a*, partially illustrating the cassette housing unit of the first embodiment. It should be noted that although FIG. 4 is used to explain swingable piece 31*a* provided to cassette guide 29*a* shown in FIG. 1, swingable piece 31*b* provided to cassette guide 29*b* has the same configuration as swingable piece 31*a* does. In FIG. 4, cassette guide 29*a* includes support 292*a*, serving as an accommodation portion or a recess, configured to support swingable piece 31*a*. Clearances in the inserting/pulling directions A exist between support 292*a* and swingable piece 31*a* which is fitted into support 292*a*. Slide guide surface 38 of swingable piece 31*a* is provided closer to media cassette 21 than inclined guide surface 293*c* and horizontal guide surface 291*a* of the guide member 29*a*.

Swingable piece 31*a* is supported by support 292*a* in cassette guide 29*a*. Swingable piece 31*a* includes: slide guide surface 38 to be in sliding contact with bottom surface 21*a* of media cassette 21; hitting surfaces 34, 35, 36, 37 as contact portions configured to come into contact with the respective portions of support 292*a*; protrusion 32 serving as a come-off preventer configured to prevent swingable piece 31*a* from coming off by being engaged with engagement portion B which is formed in support 292*a*; and swing fulcrum 36*a* as a protrusion extending in the direction orthogonal to the inserting/pulling directions A of the media cassette, and configured to enable swingable piece 31*a* to swing (turn) in the inserting/pulling directions A of media cassette 31*a*.

Support 292*a* is shaped like a hole or a recess, and includes: hitting surface 40 which is a downstream-side inner wall surface of support 292*a* provided on the downstream side in the inserting direction of media cassette 21; hitting surface 293*b* (FIG. 5) which is an upstream-side inner wall surface of support 292*a* provided on the upstream side in the inserting direction of media cassette 21; and bottom surface 30*a* (FIG. 5) of support 292*a* (FIG. 4) which is a part of top surface 30*a* of auxiliary metal plate 30. Swingable piece 31*a* is inserted into support 292*a* from above and is fitted in support 292*a*. The protrusion (swing fulcrum 36*a*) of swingable piece 31*a* is in contact with and is supported by auxiliary metal plate 30 constituting bottom surface 30*a* of support 292*a*. In this respect, a clearance exists between inner wall surface 40 of support 292*a* and swingable piece 31*a*, as well as between inner wall surface 293*b* of support 292*a* and swingable piece 31*a*. Swingable piece 31*a* is configured to be swingable about swing fulcrum 36*a* in the inserting/pulling directions A (FIGS. 1-3) of the media cassette by use of the clearances.

Thus, swingable piece 31*a* includes: the two contact portions (35, 34*b*) which are configured to come into contact with the respective side portions of support 292*a* in the inserting/pulling directions A of the media cassette; swing fulcrum 36*a* as the protrusion configured to come into contact with top surface 30*a* of auxiliary metal plate 30 (bottom surface 30*a* of support 292*a*) (see FIG. 5) which is placed in the lower portion of support 292*a* in the gravitational direction. Thus, swingable piece 31*a* is capable of swinging around the protrusion in the inserting/pulling directions A of media cassette 21. In addition, support 292*a* of cassette guide 29*a* includes engagement portion B configured to prevent swingable piece 31*a* from coming off from support 292*a* by engaging with protrusion 32 of swingable piece 31*a*. In other words, engagement portion B prevents swingable piece 31*a* from moving in the direction orthogonal to slide guide surface 38 by engaging with protrusion 32 of swingable piece 31*a*.

Figure 5:
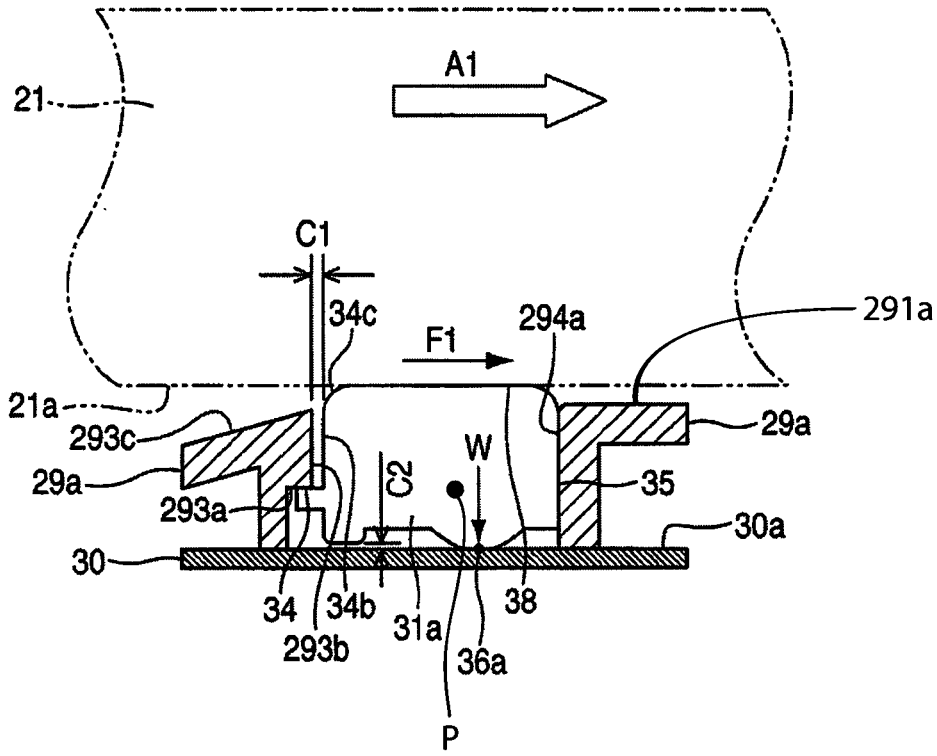
FIG. 5 is a cross-sectional view of the cassette housing unit and the media cassette of the first embodiment.
Figure 6:
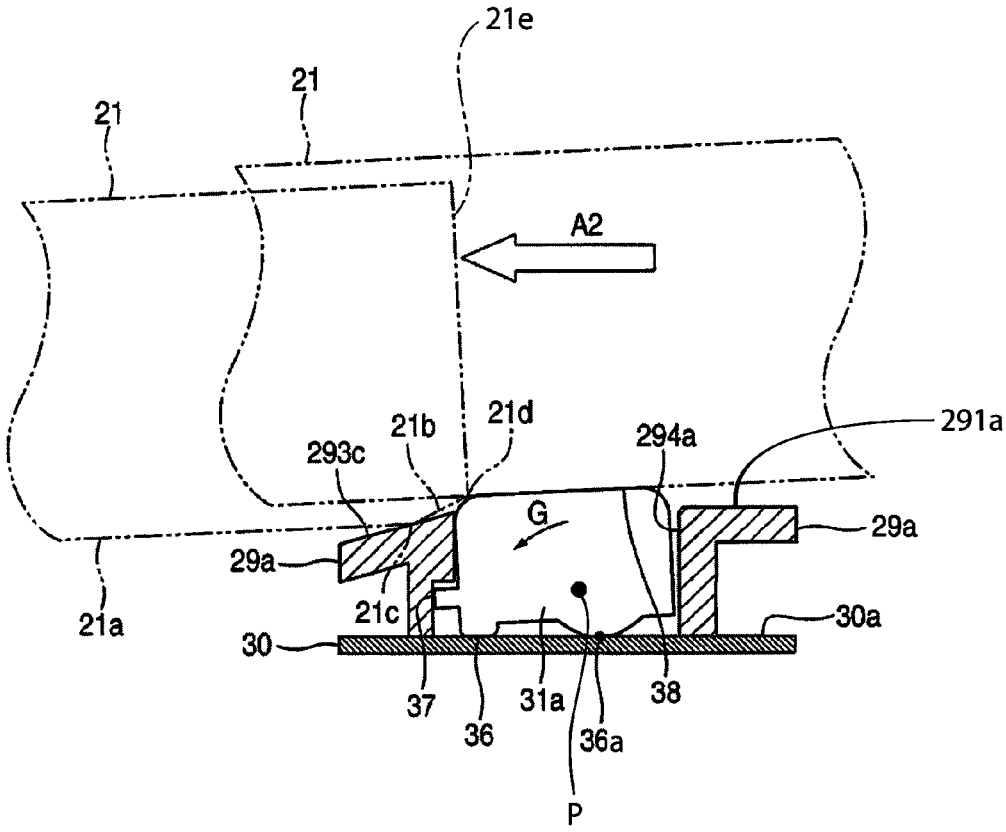
FIG. 6 is another cross-sectional view of the cassette housing unit and the media cassette of the first embodiment.

FIG. 5 and FIG. 6 are cross-sectional views of the cassette housing unit and media cassette 21 of the first embodiment. As shown in FIG. 5 and FIG. 6, cassette guide 29*a* includes: inclined guide surface 293*c* as a first guide surface; and horizontal guide surface 291*a* as a second guide surface. Inclined guide surface 293*c* and horizontal guide surface 291*a* cooperatively guide media cassette 21 from the entrance to the innermost portion of cassette housing unit 29 while slidably guiding bottom surface 21*a* of media cassette 21. Inclined guide surface 293*c* is formed such that the upstream portion of inclined guide surface 293*c* in the inserting direction of media cassette 21 is lower (that is, is farther from bottom surface 21*a* of the fully installed media cassette 21), and that the downstream portion of inclined guide surface 293*c* in the inserting direction of media cassette 21 is higher (closer to bottom surface 21*a* of the fully installed media cassette 21). Horizontal guide surface 291*a* is set substantially horizontal.

Inclined portion 21*b* is provided at an insertion leading end portion of media cassette 21 (see FIG. 6). Inclined portion 21*b* is formed between insertion leading end surface 21*e* and bottom surface 21*a* of media cassette 21 as a chamfer surface at a corner area between surfaces 21*e*, 21*a*. As a result, inclined portion 21*b* is inclined upward toward the inserting direction of media cassette 21. Inclined portion 21*b* comes into contact with inclined guide surface 293*c* of cassette guide 29*a* upon insertion of media cassette 21 into cassette housing unit 29. This makes it possible to reduce the impact of media cassette 21 hitting swingable piece 31*a* when media cassette 21 is being inserted into cassette housing unit 29 with inclined portion 21*b* of media cassette 21 in contact with inclined guide surface 293*c* of cassette guide 29*a*. Furthermore, curvature portion 34*c* (e.g. an arc portion, a circular arc portion, a round chamfered portion) is formed in a portion of swingable piece 31*a* which is hit by media cassette 21. In other words, curvature portion 34*c* is formed in a portion of swingable piece 31*a* which is closer to entrance 29*c* of cassette housing unit 29 (an upstream portion of swingable piece 31*a* in the inserting direction of media cassette 21) (see FIG. 3). This also makes it possible to reduce the impact of media cassette 21 hitting swingable piece 31*a*. Moreover, when end portion 21*d* of inclined portion 21*b* hits curvature portion 34*c* of swingable piece 31*a*, it is possible for end portion 21*d*, as it impacts or comes into contact with curvature portion 34*c*, to pass through more securely because inclined portion 21*b* is inclined with respect to a direction perpendicular to the tangent to curvature portion 34*c*. Besides, because swingable piece 31*a* is swingable, swingable piece 31*a* can make the impact of the hit pass through by turning in a direction opposite to the direction indicated by arrow G. This makes it possible to prevent swingable piece 31*a* from wearing away unevenly.

Referring to FIGS. 5 and 6, descriptions are provided for how the foregoing configuration works.

As shown in FIG. 5, while media cassette 21 is in the process of being inserted into the cassette housing unit, and when the insertion of media cassette 21 into the cassette housing unit is completed, swingable piece 31*a* turns in the inserting direction, and slide guide surface 38 in the top surface of swingable piece 31*a* accordingly becomes substantially horizontal. On the other hand, as shown in FIG. 6, while media cassette 21 is in the process of being pulled out of the cassette housing unit, and when the pulling of media cassette 21 out of the cassette housing unit is completed, swingable piece 31*a* turns in the pulling direction, and slide guide surface 38 on the top surface of swingable piece 31*a* becomes inclined downward in the pulling direction. That is to say, the swing of swingable piece 31*a* in conjunction with the insertion/pulling of media cassette 21 into/out of the cassette housing unit helps media cassette 21 to be inserted and pulled out.

Detailed descriptions are provided hereinbelow.

FIG. 5 is a cross-sectional view of the cassette housing unit and the media cassette of the first embodiment (the cross-sectional view of each taken in the inserting direction of the media cassette). FIG. 5 shows the posture the swingable piece is in while the media cassette is in the process of being inserted into the cassette housing unit and is in its home position (unit position) in the cassette housing unit. Incidentally, in the drawing, the direction indicated by arrow A1 is the direction in which the media cassette is inserted.

Reference sign W denotes the weight of media cassette 21 with sheets contained in it, and reference sign F1 denotes the force with which media cassette 21 is inserted. Once media cassette 21 is inserted into the cassette housing unit, swingable piece 31*a* turns around swing fulcrum 36*a* in the direction indicated by arrow A1 in the drawing. When hitting surfaces 34, 35 come into contact with cassette guide 29*a*, the turn of swingable piece 31*a* is restricted, and bottom surface 21*a* of media cassette 21 comes into surface contact with slide guide surface 38 which is a frictional surface between slide guide surface 38 and bottom surface 21*a* of media cassette 21. In this process, a clearance C1 between side surface 34*b* of swingable piece 31*a* and side surface 293*b* of cassette guide 29*a* on the upstream side in the inserting direction of the media cassette is 0.4 mm, for example. In addition, a clearance C2 between the bottom surface of swingable piece 31*a* and auxiliary metal plate 30 is 0.2 mm, for example.

While, as described above, the turn of swingable piece 31*a* is in the state of being restricted by the contact of hitting surfaces 34, 35 of swingable piece 31*a* with lock portions 293*a*, 294*a* (second swing restriction portions) of cassette guide 29*a* during the insertion of media cassette 21 into the cassette housing unit, hitting surface 35 of swingable piece 31*a* is shifted toward a portion of cassette guide 29*a* in the inserting direction of the media cassette. For this reason, slide guide surface 38 becomes substantially horizontal. This enables media cassette 21 to be inserted into the cassette housing unit smoothly.

FIG. 6 is another cross-sectional view of the cassette housing unit and the media cassette of the first embodiment. The cross-sectional view of each is taken in the pulling direction of the media cassette. FIG. 6 shows the posture the swingable piece is in while the media cassette is in the process of being pulled out of the cassette housing unit and when no media cassette exists in the cassette housing unit. Incidentally, in the drawing, a direction indicated by arrow A2 is the direction in which the media cassette is pulled out.

When media cassette 21 is pulled out of the cassette housing unit in the direction indicated by arrow A2, swingable piece 31*a* turns around swing fulcrum 36*a* in the direction indicated by arrow G, following the inclination of the bottom surface of media cassette 21. Thereby, hitting surface 36 of swingable piece 31*a* comes into contact with bottom surface 30*a* (a first swing restriction portion) of support 292*a*, and hitting surface 37 or hitting surface 34*b* of swingable piece 31*a* comes into contact with hitting surface 293*b* (another first swing restriction portion) of cassette guide 29*a*. Accordingly, the turn of swingable piece 31*a* is put into a state of being restricted (stopped). While in this state, swingable piece 31*a* is in a state of being inclined downward in the pulling direction of media cassette 21. In other words, media cassette 21 is pulled out on slide guide surface 38 of swingable piece 31*a*, which is inclined downward in the pulling direction, and in surface contact with the bottom surface of media cassette 21.

In this respect, in the case where the inner height H of cassette housing unit 29 in the gravitational direction, which is configured to receive media cassette 21, is formed greater than the height h of media cassette 21, when media cassette 21 is inserted into and pulled out of cassette housing unit 29, the conventional practice is that: as shown in FIG. 1B, media cassette 21 tends to be inclined relative to cassette housing unit 29 due to the external force applied by the user. The repeated slide of swingable piece 31 along bottom surface 21*a* of inclined media cassette 21 is likely to make swingable piece 31*a* wear away unevenly. In contrast, even when, as shown in FIG. 1B, media cassette 21 is inclined relative to cassette housing unit 29 due to the external force applied by the user, this embodiment makes swingable piece 31*a* swing following the inclination, and accordingly can reduce the uneven wear.

In addition, while the turn of swingable piece 31 is restricted by the contact of hitting surface 36 of swingable piece 31*a* with auxiliary metal plate 30, and by the contact of hitting surface 37 of swingable piece 31*a* with cassette guide 29*a* during the pulling of media cassette 21 out of the cassette housing unit, slide guide surface 38 is in a state of being inclined toward the downstream side in the pulling direction of the media cassette, that is to say, leftward in the drawing. This is because swing fulcrum 36*a* of swingable piece 31*a* is shifted toward a position upstream of the center of gravity P in the pulling direction of the media cassette, that is to say, rightward in the drawing, by approximately 1 mm. This enables media cassette 21 to be pulled out of the cassette housing unit smoothly.

As described above, in the first embodiment, the swingable piece which is configured to be swingable in the inserting/pulling directions A of the media cassette, and which includes the slide guide surface configured to come into sliding contact with the bottom surface of media cassette 21, is placed in the vicinity of the entrance of the cassette housing unit. From this, an effect can be obtained that: the swingable piece is capable of swinging following the condition in which media cassette 21 is inserted; the slide guide surface of the swingable piece and the bottom surface of media cassette 21 can be made to come into surface contact with each other; and accordingly, it is possible to reduce the frictional wear of the swingable piece as the sliding member in the cassette housing unit. As a result, an effect can be obtained that media cassette 21 does not become situated lower due to the frictional wear of the swingable piece. Therefore, the force with which the sheets contained in media cassette 21 push the sheet feeder roller and the separator roller can be obtained stably. Accordingly, excellent print quality can be obtained.

Embodiment 2

The configuration of a second embodiment is different from that of the first embodiment in that: the cassette housing unit includes ridge line 47 serving as the swing fulcrum for the swingable piece; and the swingable piece is bilaterally symmetrical, but not inclusive of the swing fulcrum. Descriptions are hereinbelow provided for the configuration of the second embodiment. Incidentally, parts which are the same as those of the first embodiment are denoted by the same reference numerals and signs, and descriptions for such parts are omitted.

Figure 7:
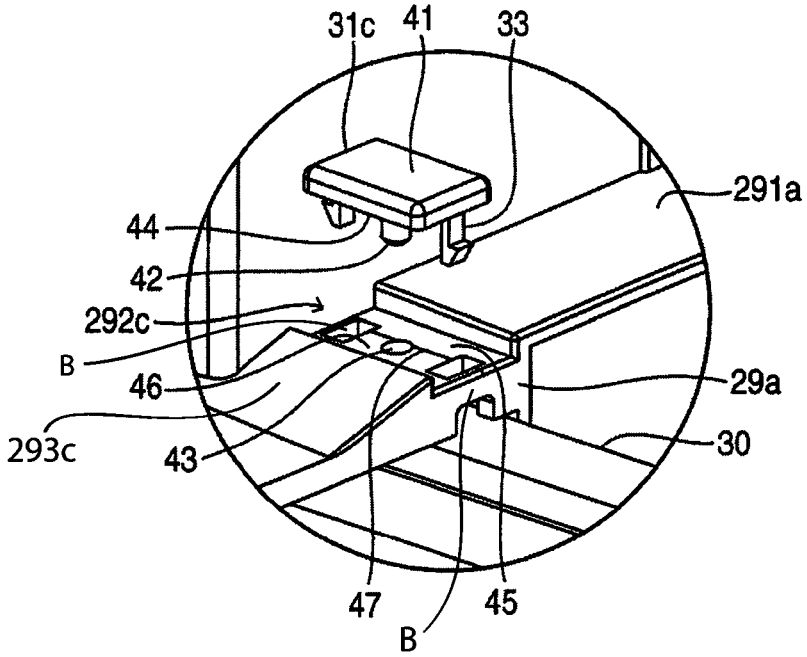
FIG. 7 is a main part perspective view of a swingable piece and a cassette housing unit of a second embodiment.

FIG. 7 is a main part perspective view of the swingable piece and the cassette housing unit of the second embodiment, and a perspective view of swingable piece 31*c* and support 292*c*. It should be noted that although the swingable piece (swingable piece 31*c* in this embodiment) provided to cassette guide 29*a* shown in FIG. 1 is described for FIG. 7, the swingable piece placed in cassette guide 29*b* has the same constitution as swingable piece 31*c* does.

In FIG. 7, cassette guide 29*a* includes support 292*c* which serves as a housing into which to fit swingable piece 31*c*. While swingable piece 31*c* is fitted in support 292*c*, clearances extending in the inserting/pulling directions A of the media cassette exist between swingable piece 31*c* and support 292*c*. Support 292*c* includes two contact portions which are configured to come into contact with the respective side portions of swingable piece 31*c* in the inserting/pulling directions A of the media cassette.

Swingable piece 31*c* is formed symmetrically with respect to both a vertical plane extending in the inserting/pulling directions A of the media cassette and a vertical plane extending in a direction orthogonal to the inserting/pulling directions A of the media cassette. Swingable piece 31*c* is supported by support 292*c*. Swingable piece 31*c* is formed inclusive of protrusion 42 which is provided to bottom surface 44 of swingable piece 31*c* to protrude downward from bottom surface 44. The cross section of swingable piece 31 in the inserting/pulling directions A of the media cassette is shaped like the letter T. The top surface of swingable piece 31*c* is formed as slide guide surface 41 which is configured to come into sliding contact with bottom surface 21*a* of media cassette 21. Bottom surface 44 of swingable piece 31*c* is formed as hitting surface 44 which is configured to come into contact with the top surface of support 292*c*. Separately from protrusion 42, lock portion 33 is formed on the bottom surface of swingable piece 31*c* to protrude from the bottom surface thereof. In this respect, lock portion 33 serves as a separation preventer configured to prevent swingable piece 31*c* from coming off support 292*c* by engaging with engagement portion B which is formed in support 292*c*.

Support surface 45 (a second swing restriction portion), support surface 46 (the other swing restriction portion), ridge line 47 and hole 43 are formed on or in support 292*c*. Support surface 45 serves as a first surface which is placed substantially horizontally, and which is configured to support swingable piece 31*c* by coming into contact with bottom surface 44 of swingable piece 31*c*. Support surface 46 serves as a second surface configured to support swingable piece 31*c* by coming into contact with bottom surface 44 of swingable piece 31*c*. Ridge line 47 is a ridge line which is a boundary between support surface 45 and support surface 46 so that ridge line 47 serves as a swing fulcrum to swingably support swingable piece 31*c*. Hole 43 serves as a loose-fit portion into which protrusion 42 of swingable piece 31*c* is loosely fit. In this respect, support surface 45 is substantially parallel to the inserting/pulling directions A of media cassette 21, and support surface 46 is inclined relative to support surface 45.

Support surface 45 extends in a substantially horizontal direction, and support surface 46 is formed inclined at a predetermined angle to support surface 45. Support surface 46 is inclined upward in the inserting direction of media cassette 21. In other words, support surface 46 is inclined downward in the pulling direction of media cassette 21. Swing fulcrum 47, which is the ridge line formed on the boundary between support surface 45 and support surface 46, extends in a direction orthogonal to the inserting/pulling directions A of media cassette 21.

In addition, protrusion 42 of swingable piece 31*c* comes into contact with two contact portions (43*a*, 43*b*) which are formed on inner side surfaces (inner side portions) of loose-fit portion 43 of cassette guide 29*a*, which are located on the upstream and downstream sides in the inserting/pulling directions A of the media cassette. There is a predetermined clearance in the inserting/pulling directions A of the media cassette between protrusion 42 and each of the contact portions 43*a* and 43*b* on the respective side surfaces (side portions) of loose-fit portion 43 of cassette guide 29*a*. Swingable piece 31*c* is fitted into support 292*c* of cassette guide 29*a* from above, and is supported by support 292*c*. Swingable piece 31*c* is configured to be capable of swinging around swing fulcrum 47 in the inserting/pulling directions A of the media cassette.

Swing fulcrum 47 is formed between the two contact portions 43*a* and 43*b* which are formed on the respective inner side surfaces (inner side portions) of loose-fit portion 43 of cassette guide 29*a* in the inserting/pulling directions A of the media cassette. Swing fulcrum 47 is preferably formed between the contact portion 43*b* on the downstream side (deeper side) in the inserting direction of the media cassette and the middle point (indicated by the chain line in FIGS. 8 and 9) which is between the two contact portions 43*a* and 43*b*.

Accordingly, cassette guide 29*a* supports swingable piece 31*c* such that the swingable piece 31*c* is capable of swinging in the inserting/pulling directions A of the media cassette, at swing fulcrum 47. Swing fulcrum 47 is placed between the two contact portions 43*a* and 43*b* which are formed on the respective inner side surfaces (inner side portions) of loose-fit portion 43 of cassette guide 29*a* in the inserting/pulling directions A of the media cassette, preferably between the contact portion 43*b* on the downstream side (deeper side) in the inserting direction of the media cassette and the middle point (indicated by the chain line in FIGS. 8 and 9) which is between the two contact portions 43*a* and 43*b*. Moreover, in the state where media cassette 21 is pulled out, slide guide surface 41 of swingable piece 31*a* is kept inclined in a direction which makes a portion of slide guide surface 41, which is closer to the insertion entrance of media cassette 21, become lower than the rest of slide guide surface 41.

Figure 8:
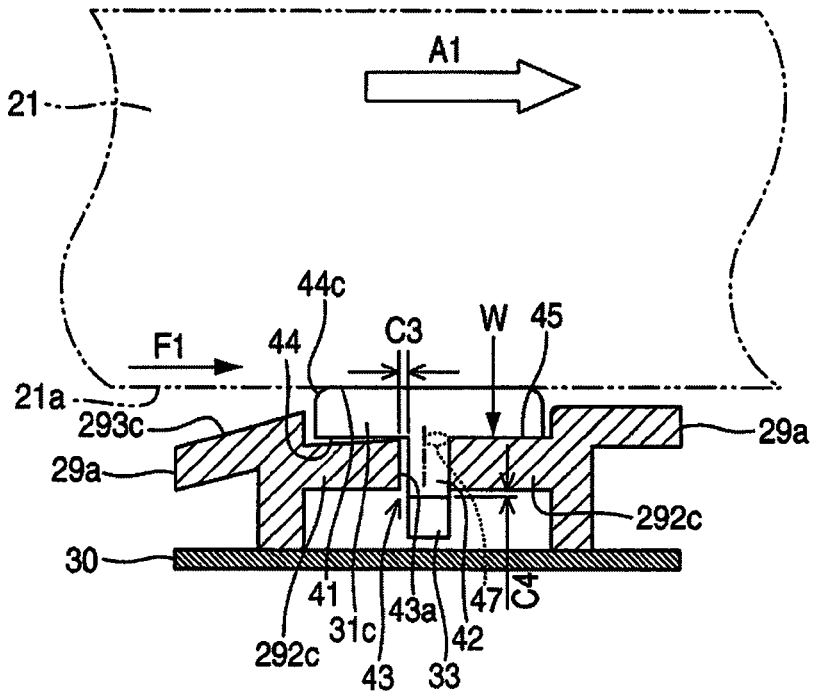
FIG. 8 is a cross-sectional view of the cassette housing unit and a media cassette of the second embodiment.
Figure 9:
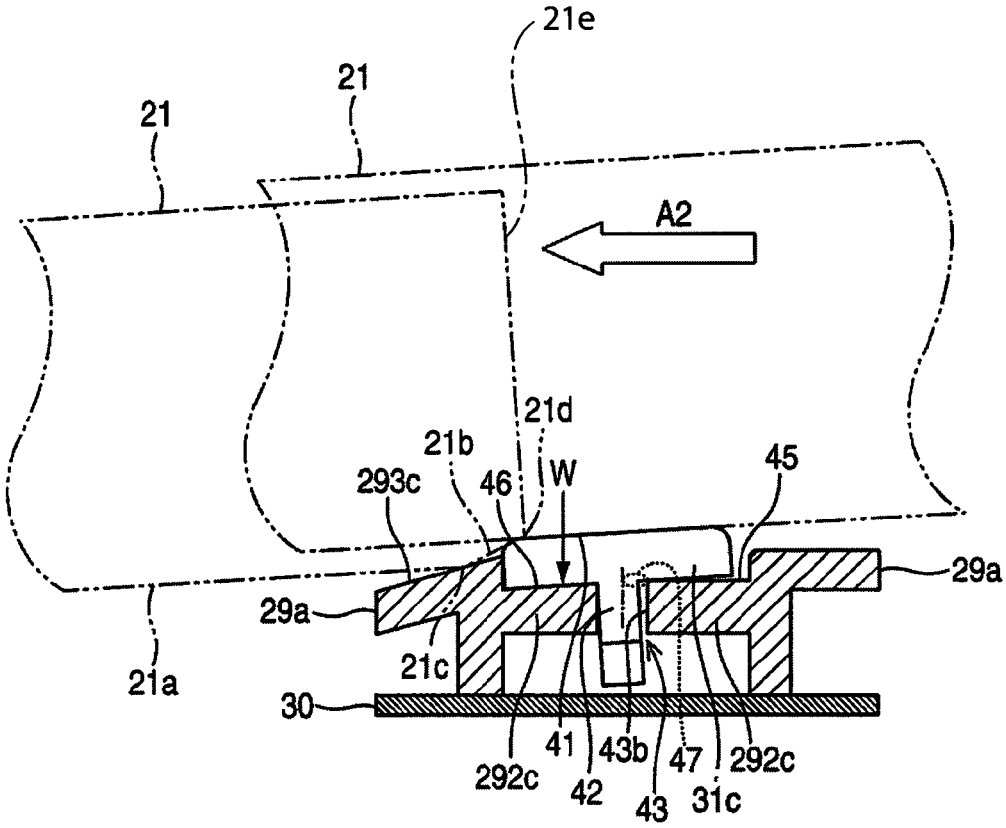
FIG. 9 is another cross-sectional view of the cassette housing unit and the media cassette of the second embodiment.

FIG. 8 and FIG. 9 are cross-sectional views of the cassette housing unit and the media cassette of the second embodiment. In FIG. 8 and FIG. 9, cassette guide 29*a* includes guide surface 293*c* as a guide portion. Guide surface 293*c* puts restrictions on media cassette 21 in order to lead media cassette 21 into cassette housing unit 29, as shown in FIG. 3, by guiding bottom surface 21*a* of media cassette 21.

As a chamfer surface obtained by cutting away a corner between leading end surface 21*e* and bottom surface 21*a*, inclined portion 21*b* is provided to the insertion leading end portion of media cassette 21. Inclined portion 21*b* is configured to come into contact with guide surface 293*c* of cassette guide 29*a* when media cassette 21 is inserted. Accordingly, while media cassette 21 is in the process of being inserted with inclined surface 21*b* of media cassette 21 in contact with guide surface 293*c* of cassette guide 29*a* when curvature portion 44*c*, formed in a portion of swingable piece 31*c* which is closer to entrance 29*c* (see FIG. 3) of cassette housing unit 29, comes into contact with end portion 21*d* of inclined portion 21*b*, it is possible for the impact of the contact to pass through. This is because inclined portion 21*b* is inclined with respect to a direction perpendicular to the tangent to curvature portion 44*c*. Besides, swingable piece 31*c* can make the impact of the contact pass through by turning in the inserting direction of the media cassette. This makes it possible to prevent swingable piece 31*c* from wearing away unevenly.

Descriptions are provided for how the above-described configuration works with reference to FIGS. 8 and 9.

As shown in FIG. 8, while media cassette 21 is in the process of being inserted into the cassette housing unit, and when the insertion of media cassette 21 into the cassette housing unit is completed, swingable piece 31*c* turns in the inserting direction, and slide guide surface 41 in the top surface of swingable piece 31*c* accordingly becomes substantially horizontal. On the other hand, as shown in FIG. 9, while media cassette 21 is in the process of being pulled out of the cassette housing unit, and when the pulling of media cassette 21 out of the cassette housing unit is completed, swingable piece 31*c* turns in the pulling direction, and slide guide surface 41 in the top surface of swingable piece 31*c* becomes inclined downward in the pulling direction. That is to say, the swing of swingable piece 31*c* in conjunction with the insertion/pulling of media cassette 21 into/out of the cassette housing unit helps media cassette 21 to be inserted and pulled out.

FIG. 8 is a cross-sectional view of the cassette housing unit and the media cassette of the second embodiment taken along a plane which is parallel to the inserting direction of the media cassette, and passes through the center of loose-fit portion 43. FIG. 8 shows the posture which the swingable piece takes while media cassette 21 is in the process of being inserted into the cassette housing unit, and while media cassette 21 is in a home (installed) position in the cassette housing unit. It should be noted that in the drawing, the direction indicated by arrow A1 is the direction in which the media cassette is inserted. Incidentally, in FIG. 8, the area in which swing fulcrum 47 is installed is indicated with a dashed line.

Reference sign W denotes the weight of media cassette 21 with sheets contained in it, and reference sign F1 denotes the force with which media cassette 21 is inserted. Once media cassette 21 is inserted into the cassette housing unit, swingable piece 31*c* turns around swing fulcrum 47 in the direction indicated by arrow A1 in the drawing. Thus, the hitting surface of swingable piece 31*c* comes into contact with hitting surface 45 of support 292*c* of cassette guide 29*a*, and protrusion 42 is fitted into loose-fit portion 43 of support 292*c*. This restricts the turn of swingable piece 31*c*, and makes the bottom surface of media cassette 21 come into surface contact with slide guide surface 41, which is a frictional surface between slide guide surface 41 and bottom surface 21*a* of media cassette 21.

In this process, a clearance C3 between a side surface of protrusion 42 (ϕ3) of swingable piece 31*c*, which is on the upstream side in the inserting direction of the media cassette, and a side surface of loose-fit portion 43 (ϕ3.3) of support 292*c* of cassette guide 29*a* is 0.3 mm, for example. In addition, a clearance C4 between lock portion 33 of swingable piece 31*c* and an engagement portion of support 292*c* is, for example, 0.3 mm.

While, as described above, the turn of swingable piece 31*c* is in the state of being restricted by the contact of the hitting surface of swingable piece 31*c* with hitting surface 45 of support 292*c* of cassette guide 29*a*, and the fitting of protrusion 42 into loose-fit portion 43 of support 292*c* during the insertion of media cassette 21 into the cassette housing unit, swingable piece 31*c* turns around swing fulcrum 47. This causes the side surface of protrusion 42 to be shifted toward support 292*c* of cassette guide 29*a* in the inserting direction of the media cassette (rightward as indicated with arrow A1 in the drawing). For this reason, slide guide surface 41 becomes substantially horizontal. This enables media cassette 21 to be inserted into the cassette housing unit smoothly.

FIG. 9 is another cross-sectional view of the cassette housing unit and the media cassette of the second embodiment taken along the plane which is parallel to the pulling direction of the media cassette, and passing through the center of loose-fit portion 43. FIG. 9 shows the posture which swingable piece 31*c* takes while media cassette 21 is in the process of being pulled out of the cassette housing unit, and while no media cassette 21 exists in the cassette housing unit. It should be noted that in the drawing, the direction indicated by arrow A2 is the direction in which media cassette 21 is pulled out. Incidentally, in FIG. 9, an area in which swing fulcrum 47 is installed is indicated with a dashed line.

When media cassette 21 is pulled out of the cassette housing unit in the direction indicated by arrow A2, swingable piece 31*c* turns around swing fulcrum 47 in the direction indicated by arrow A2, following the inclination of the bottom surface of media cassette 21. Thereby, the hitting surface of swingable piece 31*a* comes into contact with hitting surface 46 of support 292*c*, and protrusion 42 is loosely-fitted into loose-fit portion 43 of support 292*c*. Accordingly, the turn of swingable piece 31*a* is put into a state of being restricted, and the bottom surface of media cassette 21 comes into surface contact with slide guide surface 41, which is a frictional surface between slide guide surface 41 and the bottom surface of media cassette 21.

In this respect, in the case where the inner height H of cassette housing unit 29 in the gravitational direction, which is configured to receive media cassette 21, is formed greater than the height h of media cassette 21, when media cassette 21 is inserted into and pulled out of cassette housing unit 29, the conventional practice is that: as shown in FIG. 1B, media cassette 21 tends to be inclined relative to cassette housing unit 29 due to the external force applied by the user; and the repeated slide of swingable piece 31 along bottom surface 21*a* of inclined media cassette 21 is likely to make swingable piece 31*c* wear away unevenly. In contrast, even when, as shown in FIG. 1B, media cassette 21 is inclined relative to cassette housing unit 29 due to the external force applied by the user, this embodiment makes swingable piece 31*a* swing following the inclination, and accordingly can reduce the uneven wear.

In addition, while the turn of swingable piece 31*c* is restricted by the contact of the hitting surface of swingable piece 31*a* with hitting surface 46 of support 292*c* of cassette guide 29*a* and the fitting of protrusion 42 into loose-fit portion 43 of support 292*c* during the pulling of media cassette 21 out of the cassette housing unit, slide guide surface 38 is in a state of being inclined toward the downstream side in the pulling direction of the media cassette, that is to say, leftward in the drawing. This is because swing fulcrum 47 is shifted toward a position upstream of the center of gravity in the pulling direction of the media cassette, that is to say, rightward in the drawing, by approximately 1 mm. This enables media cassette 21 to be pulled out of the cassette housing unit smoothly.

As described above, what can be obtained from the second embodiment are the effect of the first embodiment, and additionally, an effect in which the holding rigidity of the cassette housing unit can be increased because the hitting surface of the cassette housing unit (which is configured to hit the swingable piece) is formed as the horizontal surface (the substantially horizontal surface) in the inserting/pulling directions A of the media cassette. In addition, because the swingable piece is formed in the bilaterally symmetrical shape, effects can be obtained, in which: it is possible to prevent the swingable piece from being wrongly inserted into the support of the cassette guide when fitting the swingable piece and the cassette guide together; and the swingable piece can be reused by turning the installation direction of the swingable piece around by 180 degrees.

It should be noted that although the first and second embodiments are described assuming that the image formation apparatus is the printer, the application of the invention is not limited to the printer. The invention may be applied to a copying machine, a facsimile machine, a multi-function printer (MFP) and the like. Furthermore, although the foregoing descriptions are provided assuming that the media cassette housing system is the media cassette housing system of the printer, the application of the invention is not limited to a printer. The invention may be applied to a media cassette housing system of any kind, such as a copying machine, a facsimile machine, a multi-function printer (MFP) and the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A media cassette housing apparatus comprising:

a guide member configured to guide an insertion of a media cassette from an entrance into an installed position of a cassette housing unit and to guide a pulling out of the media cassette from the installed position to the entrance of the cassette housing unit; and a swingable member provided to the guide member, being swingable in inserting and pulling directions of the media cassette, and including a slide guide surface configured to come into sliding contact with a bottom surface of the media cassette upon the insertion and pulling of the media cassette, wherein the slide guide surface extends along the inserting direction and the pulling direction of the media cassette and is opposed to the bottom surface of the media cassette, wherein the swingable member is swingably provided to the guide member, and wherein the bottom surface of the media cassette moves, while being in slide-contact with the slide guide surface of the swingable member, in the inserting direction and the pulling direction of the media cassette, upon the insertion and pulling of the media cassette, wherein the slide guide surface is a flat surface that extends substantially parallel to the bottom surface of the media cassette along the insertion and pulling direction of the media cassette.

2. The media cassette housing apparatus according to claim 1, wherein the guide member comprises:

a first swing restriction portion configured to stop a swing of the swingable member at a swing end point in the pulling direction of the media cassette; and a second swing restriction portion configured to stop the swing of the swingable member at a swing end point in the inserting direction of the media cassette.

3. The media cassette housing apparatus according to claim 2, wherein the first swing restriction portion is provided upstream of the second swing restriction portion in the inserting direction of the media cassette.

4. The media cassette housing apparatus according to claim 1, wherein a swing fulcrum for the swingable member is provided to the swingable member.

5. The media cassette housing apparatus according to claim 1, wherein a swing fulcrum for the swingable member is provided to the guide member.

6. The media cassette housing apparatus according to claim 1, wherein the swingable member comprises a curvature portion in a place where the media cassette makes contact with the swingable member upon the insertion of the media cassette.

7. The media cassette housing apparatus of claim 1, wherein the bottom surface of the media cassette comprises a slide surface of the media cassette.

8. An image formation apparatus comprising:

a housing including the media cassette housing apparatus of claim 1;

a media cassette capable of containing media therein and capable of being inserted into and pulled out of the cassette housing unit; and an image formation unit configured to form an image on media to be fed from the media cassette.

9. The image formation apparatus of claim 8, wherein the bottom surface of the media cassette comprises a slide surface of the media cassette.

10. The media cassette housing apparatus of claim 1, wherein the guide member includes an accommodation portion to which the swingable member is swingably attached, and wherein the swingable member is formed with an engage portion that is engageable with the accommodation portion.

11. The media cassette housing apparatus of claim 1, wherein the guide member is formed of a single piece.

12. A media cassette housing apparatus comprising:

a guide member configured to guide an insertion of a media cassette from an entrance into an installed position of a cassette housing unit and to guide a pulling out of the media cassette from the installed position to the entrance of the cassette housing unit; and a swingable member provided to the guide member, being swingable in inserting and pulling directions of the media cassette, and including a slide guide surface configured to come into sliding contact with a slide surface of the media cassette upon the insertion and pulling of the media cassette, wherein the guide member comprises:

a first swing restriction portion configured to stop a swing of the swingable member at a swing end point in the pulling direction of the media cassette; and a second swing restriction portion configured to stop the swing of the swingable member at a swing end portion in the inserting direction of the media cassette, wherein the slide guide surface of the swingable member is inclined downward toward an upstream side in the inserting direction of the media cassette in a state where the swing of the swingable member is restricted by the first swing restriction portion.

13. A media cassette housing apparatus comprising:

a guide member configured to guide an insertion of a media cassette from an entrance into an installed position of a cassette housing unit and to guide a pulling out of the media cassette from the installed position to the entrance of the cassette housing unit; and a swingable member provided to the guide member, being swingable in inserting and pulling directions of the media cassette, and including a slide guide surface configured to come into sliding contact with a slide surface of the media cassette upon the insertion and pulling of the media cassette, wherein the guide member comprises an accommodation portion configured to support the swingable member, and the swingable member comprises a protrusion functionable as a swing fulcrum in contact with a bottom surface of the accommodation portion such that the swingable member is capable of swinging about the protrusion in both the inserting and pulling directions of the media cassette.

14. A media cassette housing apparatus comprising:

a guide member configured to guide an insertion of a media cassette from an entrance into an installed position of a cassette housing unit and to guide a pulling out of the media cassette from the installed position to the entrance of the cassette housing unit; and a swingable member provided to the guide member, being swingable in inserting and pulling directions of the media cassette, and including a slide guide surface configured to come into sliding contact with a slide surface of the media cassette upon the insertion and pulling of the media cassette, wherein the guide member comprises an accommodation portion configured to support the swingable member, and the accommodation portion comprises a swing fulcrum in contact with a bottom surface of the swingable member such that the swingable member is capable of swinging in both the inserting and pulling directions of the media cassette.

15. The media cassette housing apparatus according to claim 14, wherein the swing fulcrum of the guide member comprises a ridge line as a boundary between two adjacent surfaces inclined toward each other formed in the guide member.

16. The media cassette housing apparatus according to claim 14, wherein the swingable member comprises a protrusion protruding from the bottom surface of the swingable member in a direction substantially orthogonal to the slide guide surface, the accommodation portion comprises:

a first surface facing the bottom surface of the swingable member;

a second surface facing the bottom surface of the swingable member in a place upstream of the first surface in the inserting direction, and inclined relative to the first surface;

a ridge line being a boundary between the first surface and the second surface and serving as the swing fulcrum; and a loose-fit portion into which the protrusion of the swingable member is loosely fitted, and wherein the ridge line passes through the loose-fit portion.

17. The media cassette housing apparatus according to claim 16, wherein the ridge line is provided downstream of a middle point in the inserting direction, the middle point being midway between upstream and downstream ends of the loose-fit portion in the inserting direction.

18. A media cassette housing apparatus comprising:

a guide member configured to guide an insertion of a media cassette from an entrance into an installed position of a cassette housing unit and to guide a pulling out of the media cassette from the installed position to the entrance of the cassette housing unit; and a swingable member provided to the guide member, being swingable in inserting and pulling directions of the media cassette, and including a slide guide surface configured to come into sliding contact with a slide surface of the media cassette upon the insertion and pulling of the media cassette, wherein the slide guide surface of the swingable member is kept inclined downward toward an upstream of the inserting direction of the media cassette when the media cassette is pulled out.

19. A media cassette housing apparatus comprising:

a guide member configured to guide an insertion of a media cassette from an entrance into an installed position of a cassette housing unit and to guide a pulling out of the media cassette from the installed position to the entrance of the cassette housing unit; and a swingable member provided to the guide member, being swingable in inserting and pulling directions of the media cassette, and including a slide guide surface configured to come into sliding contact with a bottom surface of the media cassette upon the insertion and pulling of the media cassette, wherein the slide guide surface extends along the inserting direction and the pulling direction of the media cassette and is opposed to the bottom surface of the media cassette, wherein the swingable member is swingably provided to the guide member, wherein the bottom surface of the media cassette moves, while being in slide-contact with the slide guide surface of the swingable member, in the inserting direction and the pulling direction of the media cassette, upon the insertion and pulling of the media cassette, wherein a swing fulcrum for the swingable member is provided to the swingable member, and wherein a center of gravity of the swingable member is located upstream of the swing fulcrum in the inserting direction of the media cassette.

20. An image formation apparatus comprising:

a housing including a media cassette housing apparatus, a media cassette capable of containing media therein and capable of being inserted into and pulled out of the cassette housing apparatus; and an image formation unit configured to form an image on media to be fed from the media cassette, the media cassette housing apparatus including:

a guide member configured to guide an insertion of the media cassette from an entrance into an installed position of a cassette housing unit and to guide a pulling out of the media cassette from the installed position to the entrance of the cassette housing apparatus;

a swingable member provided to the guide member, being swingable in inserting and pulling directions of the media cassette, and including a slide guide surface configured to come into sliding contact with a bottom surface of the media cassette upon the insertion and pulling of the media cassette;

wherein the slide guide surface extends along the inserting direction and the pulling direction of the media cassette and is opposed to the bottom surface of the media cassette, wherein the swingable member is swingably provided to the guide member, wherein the bottom surface of the media cassette moves, while being in slide-contact with the slide guide surface of the swingable member, in the inserting direction and the pulling direction of the media cassette, upon the insertion and pulling of the media cassette, and wherein the media cassette comprises an inclined portion in a leading end portion of the media cassette in the inserting direction of the media cassette, with the inclined portion being inclined relative to the inserting direction and provided at a position where the media cassette makes contact with the swingable member upon the insertion of the media cassette.

21. The image formation apparatus of claim 20, wherein the inclined portion of the media cassette is inclined upward toward the inserting direction.

22. The image formation apparatus of claim 20, wherein the inclined portion of the media cassette is a chamfer portion provided between a leading end surface provided to the leading end of the media cassette in the inserting direction and a bottom surface of the media cassette.

* * * * *